US005874700A

United States Patent [19]

Hochgesang

[11] Patent Number: 5,874,700

[45] Date of Patent: Feb. 23, 1999

[54] SWITCH MAT

[75] Inventor: Gerhard Hochgesang, Bad Neustadt, Germany

[73] Assignee: Preh-Werke GmbH & Co. KG, Bad Neustadt, Germany

[21] Appl. No.: 812,326

[22] Filed: Mar. 5, 1997

[30] Foreign Application Priority Data

Mar. 7, 1996 [DE] Germany ..... 196 08 773.2

[51] Int. Cl.[6] ..... H01H 13/70

[52] U.S. Cl. ..... 200/515

[58] Field of Search ..... 200/515

[56] References Cited

U.S. PATENT DOCUMENTS

| | | | |
|---|---|---|---|
| 3,683,600 | 8/1972 | Rice | 55/385 |
| 3,888,117 | 6/1975 | Lewis | 73/141 A |
| 3,898,421 | 8/1975 | Suzumura | 200/515 X |
| 4,485,279 | 11/1984 | Nakamura | 200/515 X |

FOREIGN PATENT DOCUMENTS

| | | |
|---|---|---|
| 29 45 707 | 6/1980 | Germany . |
| 38 09 770 | 10/1989 | Germany . |
| 90 12 407.3 | 2/1992 | Germany . |
| 42 12 562 | 4/1992 | Germany . |
| 43 12 664 | 7/1994 | Germany . |

*Primary Examiner*—Renee S. Luebke

*Attorney, Agent, or Firm*—Griffin, Butler Whisenhunt & Szipl, LLP

[57] ABSTRACT

This invention relates to a switch mat with key switches. In previously disclosed switch mats, switch chambers located under dome-shaped key caps were jointly vented. This affected key operation, and allowed soiling by dust and moisture. Here, each switch chamber has a ventilating channel with a filter layer that is permeable to air, for venting to and from the outside. In this design, the filter layer is formed by a filter matting that is dust and moisture-repellent. Because each switch chamber is separately vented to and from the outside, there is no mutual influence on operating forces of the key switches.

3 Claims, 1 Drawing Sheet

SWITCH MAT

BACKGROUND OF THE INVENTION

This invention relates to switch mats of a type having several key switches, each of which has a dome-shaped key cap for being pressed toward a contact sheet by a key to complete a contact with a contact lug, with switch chambers under the respective key caps being connected to atmosphere by a ventilating channel. Switch mats of this type comprise individual or multiple adjacent key switches arranged as a keyboard, and are used in electrical control panels or in data entry keyboards.

A dome-shaped key cap is placed over an actuating element of each key switch; for keyboards, the key cap may be designed as a mat. Venting air out of and into a switch chamber inside the key cap is absolutely essential when the key cap is pressed. This can be accomplished by releasing the air directly to atmosphere, or by venting the air into and out of other switch chambers, with an equalizing of pressure.

German patent document (DE-38 09 770 C2) discloses a key switch of this type. A disadvantage of this system is that when air is vented directly outside, dust and moisture are drawn back into a switch chamber with an ensuing air intake.

By contrast, if the air is vented into and out of other switch chambers, as disclosed in German patent document (DE 29 45 707 C2), no dust or moisture can come in. However, because of an air cushion and a resulting change in pressure, an operating force of a key switch is modified for a switch chamber of this type, which may result in incorrect key operation.

German patent document (DE 42 12 562 A1) discloses a contact-sheet keypad with snap keys. Ventilation holes are located next to the keys to allow air to be vented out and in during keying. Air under the snap keys is not removed; rather, it remains there to act as a pneumatic spring, generating return force.

In one embodiment of German patent document (DE 90 12 407.3 U1), a minimum of two outlets must be provided in a support layer to permit pressure equalization for a press switch element. In this design, air ventilation for a gap in a contact area takes place through a filter material and the outlets. To prevent destruction by corrosion of a switching matrix, it is recommended either that an insulating break in an electrically conductive layer be provided at a periphery of a contact area, with a center contact, or that an additional desiccating agent, e.g. silica gel, be used. This is very expensive, and cannot be used for key switches of a switch mat.

It is an object of this invention to provide such a switch mat that does not allow dust and moisture to penetrate in during ventilation, while also not influencing a switching procedure.

SUMMARY

According to principles of this invention, a switch mat with several key switches, has a dome-shaped key cap for each key switch to be pressed toward a contact sheet by a key to complete a contact with a contacting lug, with switch chambers under the respective key caps being connected to atmosphere by a ventilating channel. Each switch chamber has a ventilating channel to atmosphere in which a filter layer that is permeable to air is placed between a contact sheet and a support with the filter layer being formed as a dust and moisture-repellent filter fibrous matting.

Operating forces remain unaffected because air is vented into and out of each switch chamber separately. Also, the switching system is prevented from becoming contaminated.

BRIEF DESCRIPTION OF THE DRAWING

The invention is described and explained in more detail below using an embodiment shown in the drawing. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawing in which reference characters refer to the same parts throughout the different views. The drawing is not necessarily to scale, emphasis instead being placed upon illustrating principles of the invention in a clear manner.

DESCRIPTION OF THE PREFERRED EMBODIMENT

Figure 1:
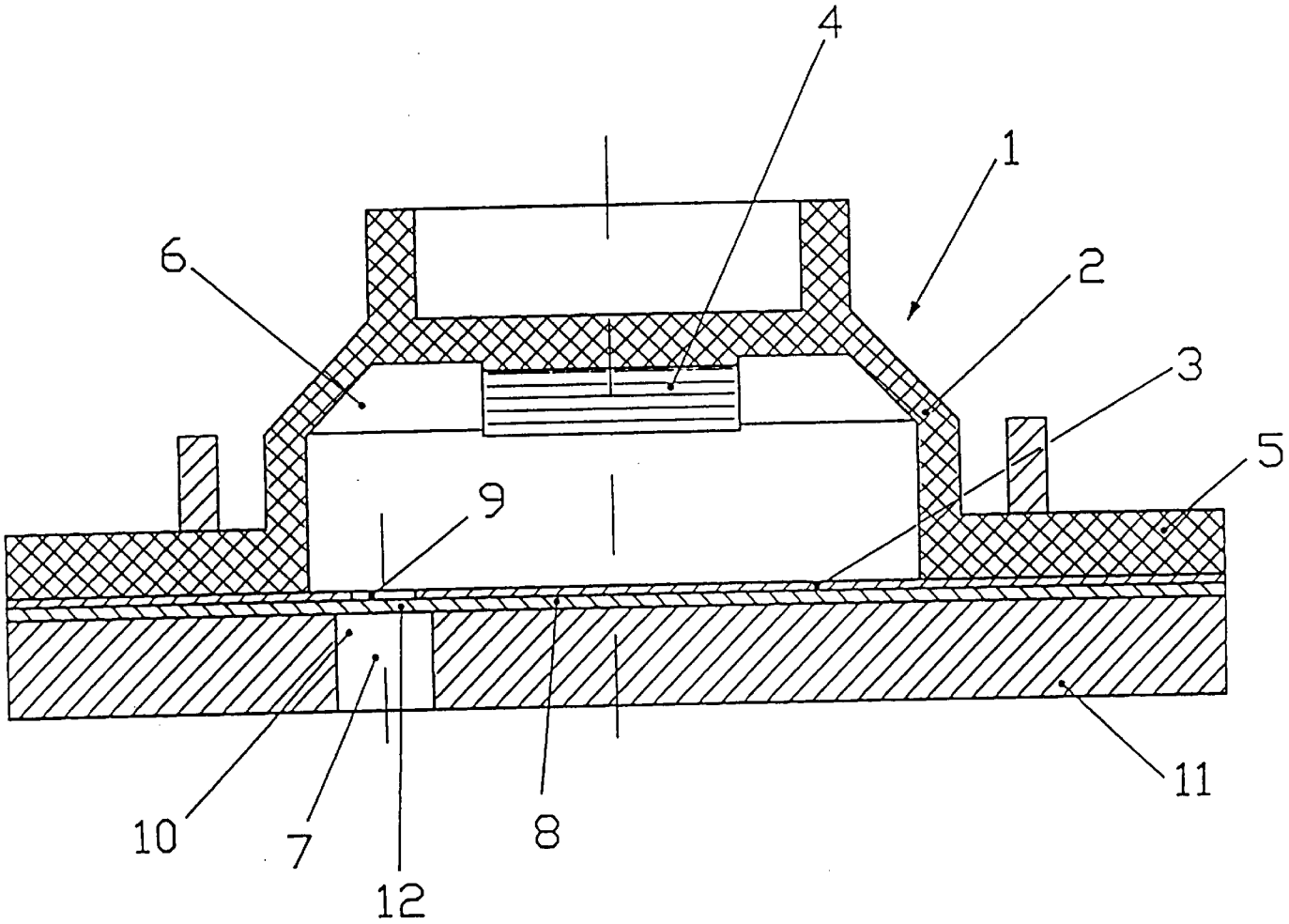
FIG. 1 shows a sectional view of a stylized key switch in a switch mat of this invention.

The drawing shows a schematic view of a key switch 1, as part of a switch mat 5 including many key switches, with a dome-shaped key cap 2 which can be pressed onto a contact sheet 3, by means of a key (not shown), to thereby bring the contact sheet into electrical contact with a contact lug 4. A switch chamber 6 under the key cap 2 communicates with atmosphere via a ventilating channel 7 so that air inside the switch chamber 6 can flow out and in when the cap is actuated. The ventilating channel 7 is formed by openings 9, 10 in the contact sheet 3 and in a support 11.

According to this invention, the ventilating channel 7 also has a filter layer, or sheet, 8 that is permeable to air, so that dust and moisture cannot penetrate into, or be sucked into, the switch chamber 6, with a filter web, fibrous matting, fleece, or nonwoven-fibrous-web 12 that forms the filter layer 8 being placed between the contact sheet 3 and the support 11.

As illustrated in the drawing, the openings 9, 10 in the contact sheet 3 and the support 11 are located in an area of the switch chamber 6, i.e. each switch chamber has its own ventilating channel.

The filter layer 8, or the filter matting 12, located between the contact sheet 3 and the support 11 is advantageously dust and moisture repellent. It is preferably 0.15 mm to 0.5 mm thick, preferably 0.2 mm.

The key switch 1, as part of the switch mat 5 of this invention, is easy to actuate because the switch chamber 6 is ventilated. The thusly exchanged air is freed of dust and moisture by the filter layer 8, 12, so that the contacts and the contact lug 4 cannot be soiled.

The preferred embodiment can be manufactured advantageously by mass production.

The invention claimed is:

1. A switch-mat apparatus comprising a switch mat and a contact sheet, and switch mat apparatus having several key switches with each key switch having a dome-shaped key cap of the switch mat for being pressed toward the contact sheet by a key to complete a contact between a first contact of the contact sheet and a second contact pressed against the first contact by the dome-shaped key cap, with a plurality of key-cap chambers, one under each of the respective key caps, being connected to atmosphere by a ventilating channel, wherein each key-cap chamber has a ventilating channel to atmosphere, said switch mat apparatus further including a fibrous non-woven filter matting layer for each switch chamber that is permeable to air placed over the ventilating channel so that air passing through said ventilating channel must pass through said non-woven fibrous filter matting layer and said contact sheet lying directly on said non-woven fibrous filter matting layer, with the non-woven fibrous filter matting layer consisting essentially of non-coated, non-woven fabric which is dust and moisture-repellent.

2. A switch-mat apparatus as in claim 1, wherein is further included a support plate for supporting said contact sheet, with said non-woven fibrous filter matting layer being between said support plate and said contact sheet and said contact sheet lying directly on said non-woven fibrous filter matting layer, the ventilation channels being formed by contact-sheet openings in the contact sheet and support-plate openings in the support plate at areas of the key-cap chambers, said non-woven fibrous filter matting layer, therefore, being between said contact-sheet openings and said support-plate openings.

3. A switch-mat apparatus as in claim 2 wherein there is a single contact sheet and a single support plate for a plurality of the dome-shaped key caps and wherein the non-woven fibrous filter matting layer for the plurality of key-cap chambers is formed by a single non-woven fibrous filter matting sheet placed between said single support plate and said single contact sheet which filters air passing through the ventilating channels for the plurality of key-cap chambers.

* * * * *